US007861465B1

(12) United States Patent
Christ et al.

(10) Patent No.: US 7,861,465 B1
(45) Date of Patent: Jan. 4, 2011

(54) FLEXIBLE DOOR GUARD

(76) Inventors: Joseph Christ, 2615 Castlewood, Dyer, IN (US) 46311; Ronald Christ, 319 Sherwood Dr., Crown Point, IN (US) 46307

( * ) Notice: Subject to any disclaimer, the term of this patent is extended or adjusted under 35 U.S.C. 154(b) by 0 days.

(21) Appl. No.: 12/563,503

(22) Filed: Sep. 21, 2009

(51) Int. Cl.
*E06B 3/00* (2006.01)

(52) U.S. Cl. ..... 49/506; 49/383

(58) Field of Classification Search ..... 49/383, 49/384, 506; 160/40
See application file for complete search history.

(56) References Cited

U.S. PATENT DOCUMENTS

| | | | | |
|---|---|---|---|---|
| 474,633 | A * | 5/1892 | Glazier | 49/383 |
| 1,444,398 | A | 2/1923 | Shepherd | |
| 2,641,792 | A | 6/1953 | Peeler | |
| 2,910,741 | A * | 11/1959 | Dettman | 49/383 |
| 2,995,785 | A | 8/1961 | Hallenbeck | |
| 3,302,690 | A * | 2/1967 | Hurd | 160/40 |
| 4,040,142 | A * | 8/1977 | Ippolito | 16/251 |
| 4,878,267 | A | 11/1989 | Roach et al. | |
| 5,001,862 | A * | 3/1991 | Albenda | 49/383 |
| 5,092,077 | A * | 3/1992 | Teinturier-Milgram | 49/383 |
| 6,141,909 | A * | 11/2000 | Hanson | 49/303 |
| 6,477,809 | B1 * | 11/2002 | Dorner et al. | 49/383 |
| 6,497,073 | B2 * | 12/2002 | Webb | 49/383 |
| 6,796,086 | B2 * | 9/2004 | Albenda | 49/383 |
| 7,311,366 | B2 * | 12/2007 | Kim et al. | 312/7.2 |
| 2004/0098916 | A1 * | 5/2004 | Albenda | 49/383 |
| 2005/0183342 | A1 * | 8/2005 | Holden | 49/383 |

FOREIGN PATENT DOCUMENTS

| | | | |
|---|---|---|---|
| FR | 2666841 | A1 * | 3/1992 |
| WO | WO 9011427 | A1 * | 10/1990 |

* cited by examiner

*Primary Examiner*—Jerry Redman
(74) *Attorney, Agent, or Firm*—Marshall, Gerstein & Borun LLP

(57) ABSTRACT

A method of preventing finger access into a space between a hinged edge of a door member that is unexposed when the door is closed, and that is hingedly attached to a door jamb member with spaced hinges, and a surface of said jamb member that is unexposed when the door is closed, comprising cutting a first section of flexible sheet material, having a width sufficient to allow the door to be opened and closed when opposed longitudinal edges of the flexible sheet material are affixed, respectively, to said hinged edge of the door member and said surface of the jamb member on a side of the door having protruding hinges, to a length about equal to a spacing between said spaced hinges securing the opposed longitudinal edges of said first section of flexible sheet material, respectively, to said hinged edge of the door member and said surface of the jamb member between the spaced hinges, without covering the hinges with said first section of flexible sheet material, and optionally securing a second section of flexible sheet material below the first section of flexible sheet material, without covering a hinge.

8 Claims, 3 Drawing Sheets

FLEXIBLE DOOR GUARD

FIELD OF THE INVENTION

This invention relates generally to door guards and, more specifically, to door guards that can be easily mounted to any hinged door, to prevent little children from getting their fingers pinched between the door and the door jamb of building and closet doors.

BACKGROUND

One of the problems with hinged doors is that, as the door is swung open, a gap is formed between the hinged edge of the door and the door jamb member. When the door is closed, the gap closes as the edge of the door moves into the gap. However, because of the mechanics of the door, the door itself becomes a lever arm where closing the door with only a small force can generate a substantial force at the edge of the door which can crush or break a child's finger located in the gap between the hinged door member edge and the door jamb member. Small children are often unaware of the danger and may place their fingers in the gap between the hinged door edge and the door jamb, as the door is closed.

The prior art is replete with various types of door guards. However, some of the guards must be specially modified to fit over hinges and, therefore, are difficult to manufacture in complicated shapes, and difficult to install on the door. Still others have members that ride or wear against the door, or must be attached to an exposed outer surface of the door, causing damage to the door and door repair or replacement is necessary after removal. Since door guards are usually only necessary when children are small, one desires to have a door guard capable of being quickly and temporarily attached to the door and the door jamb, and when the children become aware of the dangers of placing their fingers between the door and the jamb, the door guard can be removed without requiring door or door jamb repair.

The door guards described herein are easily and quickly attached and removed from the door and door jamb, without door damage and prevent people, particularly little children, from having a closing door crush their fingers. The door guard is installed in one or more sections by being secured to the door jamb member and to the hinged door member edge adjacent to a hinge-protruding side of the door jamb member, only between, and optionally above and/or below, the hinges (not covering the hinges) so that the hinges are always exposed. The hinges fill the gap separating door guard sections between the hinged door edge and door jamb.

DESCRIPTION OF THE PRIOR ART

U.S. Pat. No. 2,995,785 shows a door guard having a U-shape with members extending on the opposite sides of the door. The U-shaped members have rollers that roll along the surface of the door. Besides marring the door through wear, the unit requires removal of the door for installation of the door guard.

U.S. Pat. No. 4,878,267 shows a complicated extruded plastic tube, having a seven-faceted cross-section that covers the hinges on one side and is secured to an inside edge of the door and to the door jamb, requiring door removal for installation. The closed shape fits in the opening between the door and the door jamb and requires reworking the door and the door jamb to accommodate the door guard.

U.S. Pat. No. 2,641,792 shows a hinge guard which is attached to an outer face of the door and door frame to completely cover the hinges and door opening.

U.S. Pat. No. 1,444,398 shows a hinge guard having a bellows-like member which expands and contracts to cover the hinges and opening between the door and the casing.

BRIEF SUMMARY

Described herein is a flexible polymeric door guard for temporarily bridging and covering the opening between a hinged door edge and a door casing or jamb, with the door guard being easily installed in one or more sections between hinges, on the hinge-protruding side of the door, and optionally below a lower hinge, and is easily removed, e.g., by a homeowner. The door guard covers the door openings, on a hinge-protruding face of the door, only between the hinges (not over the hinges), and optionally below the lower hinge. The door guard is attached only to inner door edge and door jamb surfaces that are hidden (unexposed) when the door is closed. The door guard is formed of a flexible polymeric sheet material that may be transparent or colored to match the door and/or door jamb color.

DESCRIPTION OF THE PREFERRED EMBODIMENT

Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 3:
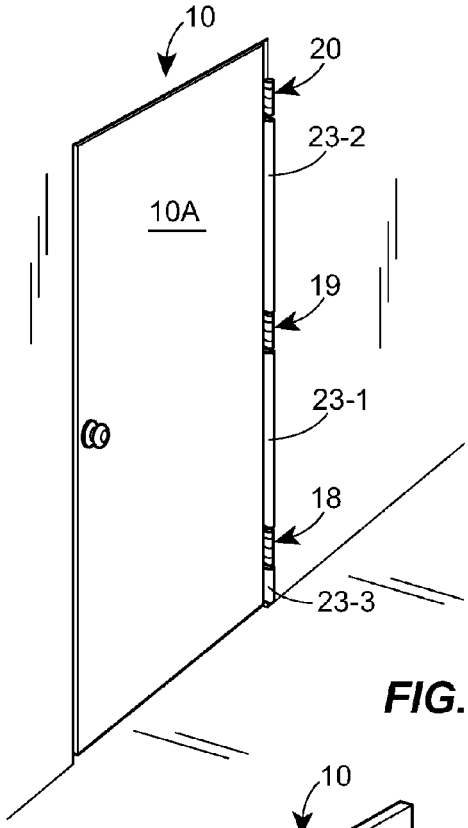
FIG. 3 is a perspective view showing the door in a closed position showing three sections of door guards, cut from the door guard material of FIG. 1, in place on the hinge-protruding side of the door.
Figure 4:
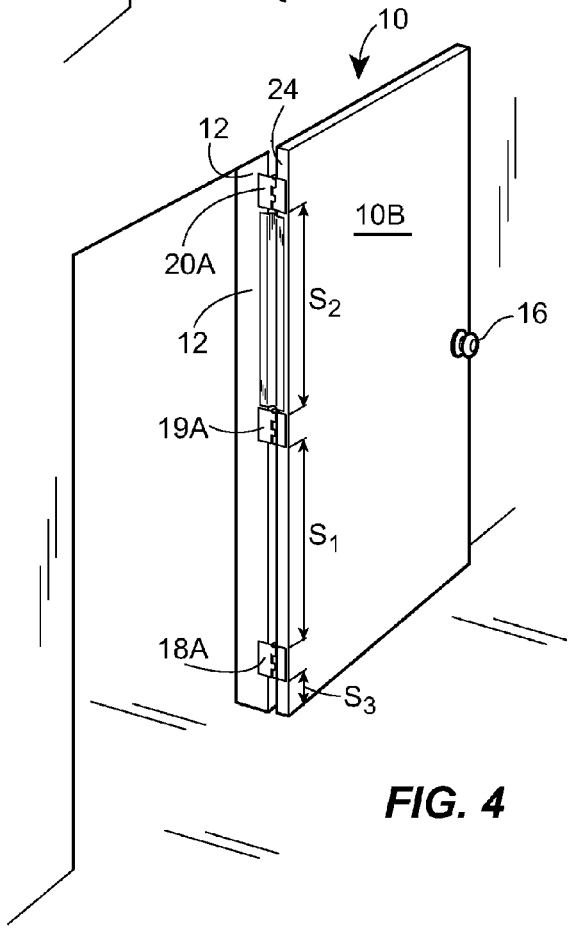
FIG. 4 is a perspective view of an open door to show an inside edge of the door and door jamb with one section of a door guard material of FIG. 1 attached to the door jamb and door edge, between door hinges.

Turning first to FIG. 3, reference numeral 10 generally identifies a door of a building, e.g., a house. The door 10 includes a hinge-protruding side 10A and a hinge-non-protruding side 10B. Door 10 fits within the confines of a door jamb member 12 and includes a door knob 16 for opening and closing the door 10. Attached along the hinged edge of door 10 and the door jamb member 12, on a side of the door having protruding lower, middle and upper hinges 18, 19 and 20, and between (but not over) the hinges 18 and 19 and 19 and 20, is the door guard 23, preferably installed in a plurality of sections 23-1 and 23-2 below and above the center hinge 19. A door section 23-3 also may be installed below lower hinge 18 to prevent children from finger damage under lower hinge 18. The door member 10 has a vertical, longitudinal, hinged planar edge 24 including hinge plates 18A, 19A and 20A (FIG. 4) where door guard material is secured, as described herein in the preferred embodiment. The door member edge 24 is unexposed when the door 10 is closed, as shown in FIG. 3, and when the door 10 is closed, the EDGE 24 is adjacent to an unexposed door jamb member 12. When the door is closed, this longitudinal door member edge 24A is slightly spaced from the planar door jamb member 12.

Figure 1:
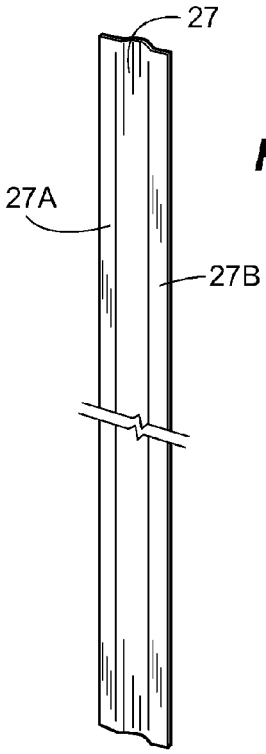
FIG. 1 is a partially broken-away perspective view of a sheet material, forming a part of a door guard kit, which can be cut to fit between, above and below door hinges to extend outwardly from a hinge-protruding side of a door.
Figure 2:
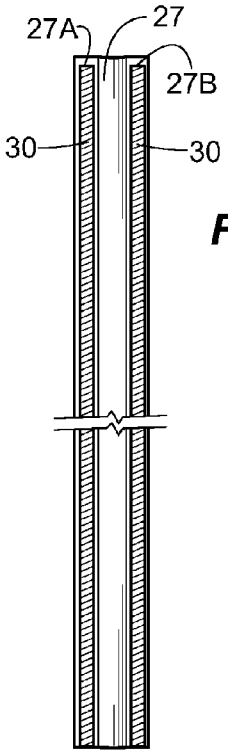
FIG. 2 is a partially broken-away perspective view showing the sheet material of FIG. 1 having adhesive or two-sided adhesive strips adhered to outer longitudinal portions of the sheet material, prior to adhering the sheet material in place.

The door guard sections 23-1, 23-2, and optionally 23-3 (FIG. 3) are secured to the longitudinal door edge 24 and door jamb 12 to protrude outwardly from the hinge-protruding door side 10A and are easily cut, by the homeowner, from a flexible polymeric sheet material, designated by reference numeral 27 in FIG. 1, such as MYLAR® (polyethylene terephthalate); polyamides, such as nylon; polyolefins, such as polyethylene, polypropylene or copolymers of ethylene and propylene; polyvinyl chloride, or the like. The sheet material 27 should have sufficient flexibility and flexural strength so that it can flex upon door movement to the open and closed positions without cracking. In the preferred embodiment, the sheet material 27 is about 2 to about 4 inches wide, preferably about 3 inches wide, and is formed (curled) during manufacture, or heat-curled after manufacture, to provide an arcuate curl at its center, as shown in FIGS. 1 and 2, between planar adhesive-contacting outermost edges 27A and 27B. The sheet of sheet material 27 has a width that is sufficient to allow the door 10 to be opened and closed when the sheet material 27 is secured to the door edge 24 and the adjacent door jamb member 12. A shown in FIG. 3, On the hinge-protruding side 10A of the door member 10, the flexible sheet material 27 is cut to lengths about equal to (preferably within about a half inch of) a spacing $S_1$, between said adjacent, -spaced hinges 18 and 19 and optionally a length $S_3$ below hinge 18 and a length $S_2$ between hinges 19 and 20. In a preferred embodiment, another section of sheet material 29 is secured to the door edge 24 and the adjacent jamb member 12 on the non-hinge-protruding (hinge plate) side 10B of the door 10 to protect against finger access on both sides 10A and 10B of door member 10.

Opposed longitudinal outermost positions 27A and 27B of a first section 23-1 of flexible sheet material 27, cut to length $S_1$, are adhesively affixed to the hinged edge 24 of the door member 10, on the hinge-protruding side 10A of the door member 10, and to the door jamb member 12 between the pair of hinges 18 and 19 (27A affixed to door edge 24 and 27B affixed to door jamb member 12, or vice versa), without covering the hinges 18 or 19 with the first section 23-1 of flexible sheet material 27. A second section 23-2 of sheet material 27, having a length $S_2$, can be secured to the door edge 24 and door jamb 12, between middle hinge 19 and upper hinge 20, to protect against finger access by taller children and adults. Optionally, if toddlers are present, a third section of flexible sheet material 23-3, having length $S_3$, can be secured to the hinge-protruding side 10A of the door jamb member 12 and adjacent hinged door edge 24, below the lower hinge 18.

Figure 5:
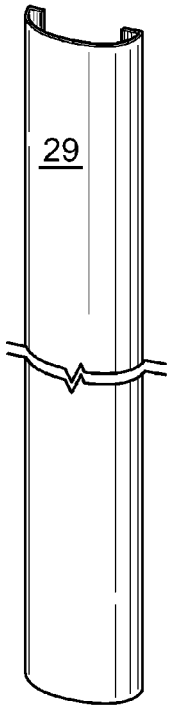
FIGS. 5 and 6 are perspective views of a wider sheet of sheet material having an adhesive or two-sided adhesive strips applied to outer portions of the sheet material for adhesively affixing the sheet material to an edge of the door and door jamb to extend outwardly from an opposite (hinge plate) side of the door, in a direction opposite to the sheet material of FIG. 1.
Figure 6:
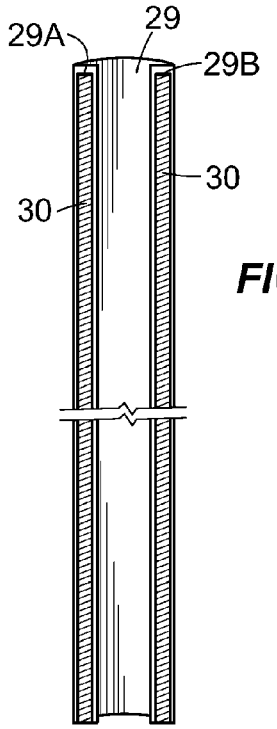

In accordance with another embodiment of the door guard described herein, another section 29 of flexible sheet material, which may be the same as, or different polymeric sheet material than the sheet material 27, also can be secured to the outer door jamb member 12 and to the edge 24 of the door member 10 to protrude outwardly from the opposite side 10B of door 10 to protect against finger access on both sides 10A and 10B of the door member 10, as shown in FIGS. 5-9. In the preferred embodiment, the sheet material 29 is about 4 to about 7 inches wide, preferably about 5½ inches wide, and is formed (curled) during manufacture, or heat-curled after manufacture, to provide an arcuate curl at its center, as shown in FIGS. 5 and 6, between planar adhesive-contacting outermost edges 27A and 27B.

Figure 7:
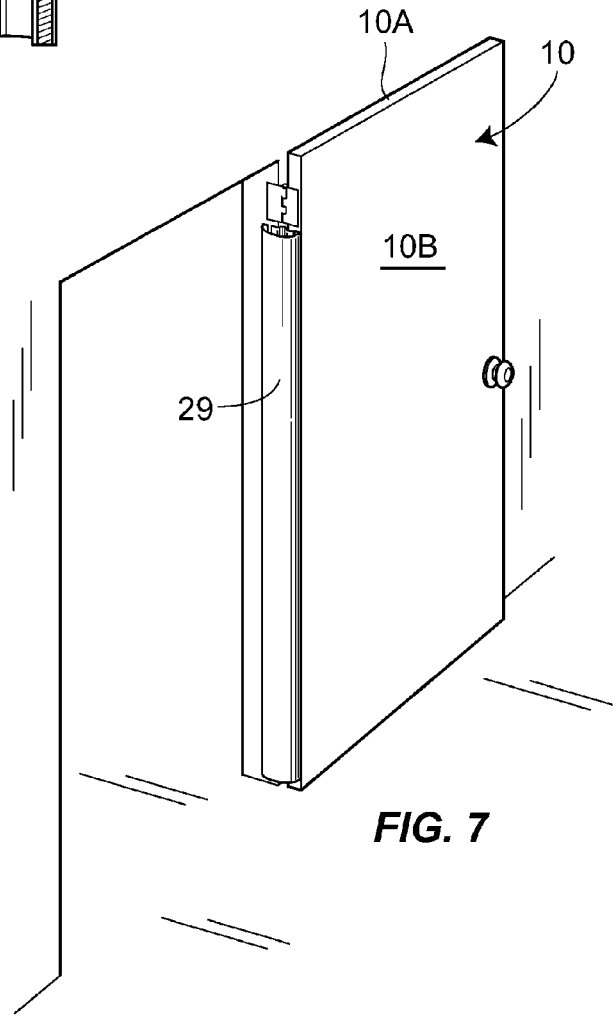
FIG. 7 is a perspective view of an inside of the door (door open) and door jamb with the door guard material of FIGS. 5 and 6 in place on an inside (non-hinge-protruding or hinge plate) side of the door.

Section 29, secured on the hinge non-protruding (hinge plate) side 10B of door 10, will cover hinge plates 18A and 19A of hinges 18 and 19, as shown in FIG. 7, and also may extend to cover hinge plate 20A of upper hinge 20.

As shown in FIGS. 2 and 6, outer longitudinal portions 27A, 27B of sheet material 27; and outer longitudinal portions 29A and 29B of sheet material 29, may be pre-assembled to include two-sided adhesive tape or strips 30—one side pre-secured to the sheet materials 27 and 29 at outermost portions 27A, 27B, 29A, 29B, as shown in FIGS. 2 and 6, and a strippable release sheet (not shown) covering exposed adhesive strips 30.

Figure 8:
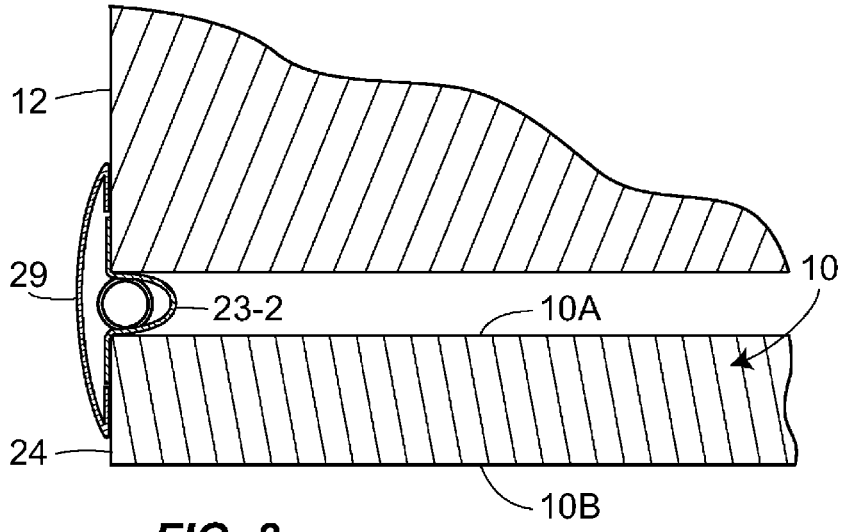
FIGS. 8 and 9 are broken-away top views of FIGS. 4 and 7, respectively, showing the door in the closed and open positions, respectively.
Figure 9:
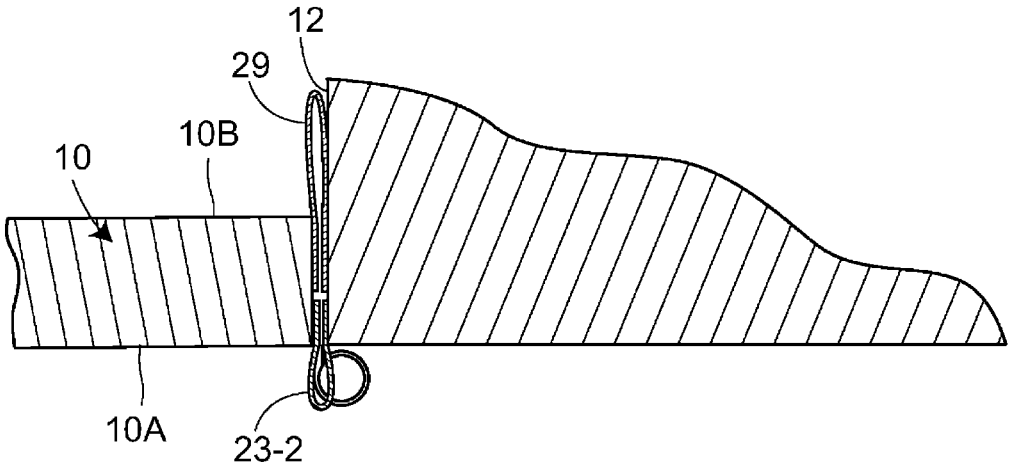

As best shown FIG. 8, one, two, or three door guard section 23-1, 23-2 and 23-3 on the hinge-protruding side 10A of door 10, with section 23-2 shown in FIG. 8, is secured to the door edge 24 and door jamb 12, prior to securing door guard section 29 in place on the hinge-plate side 10B of door 10, jamb 12. After securing the desired number of hinge-protruding side door guards in position (23-1, 23-2 and/or 23-3) to protrude from door side 10A, the door guard 29 that protrudes from the hinge plate side 10B is easily secured to the door edge 24 and door jamb 12 outside of the portions of door edge 24 and door jamb occupied by the door guard sections 23-1, 23-2 and/or 23-3.

Preferably, the adhesive used to secure the door guard sections 23-1, 23-2, 23-3 and 29 in position is a pressure-sensitive adhesive so that each time the door is closed (see FIG. 9) pressure is applied to the adhesive to maintain the door guard sections secured in place.

What is claimed:

1. A method of preventing finger access into a space between a hinged edge of a door member that is unexposed when the door is closed, and that is hingedly attached to a surface of a door jamb member with spaced hinges each having a protruding portion, and said surface of said jamb member that is unexposed when the door is closed, comprising:

cutting a first section of flexible sheet material, having a width sufficient to allow the door to be opened and closed when opposed longitudinal edges of the flexible sheet material are affixed, respectively, to said hinged edge of the door member and said surface of the jamb member on a side of the door having the protruding portion of said spaced hinges, to a length about equal to a spacing between said spaced hinges;

securing the opposed longitudinal edges of said first section of said flexible sheet material, respectively, to said hinged edge of the door member and said surface of the jamb member between the spaced hinges, without covering the protruding portion of the spaced hinges with said first section of said flexible sheet material, including the step of cutting a second section from said flexible sheet material to a length with opposed longitudinal edges, and securing the opposed longitudinal edges of said second section of said flexible sheet material, respectively, to said hinged edge of the door member and said surface of the jamb member between two spaced hinges or below a lower hinge that is adjacent to said first section of the flexible sheet material on the side of the door having said protruding portion of said spaced hinges.

2. The method of claim 1, wherein the flexible sheet material comprises a polymeric sheet material having a thickness in the range of about 3 mils to about 30 mils.

3. The method of claim 1, wherein the flexible sheet material comprises a polymeric sheet material having a thickness in the range of about 5 mils to about 20 mils.

4. The method of claim 2, wherein the polymeric sheet material has a width in the range of about 2 inches to about 5 inches.

5. The method of claim 2, wherein the polymeric sheet material is selected from the group consisting of polyethylene terephthalate, polyolefin homopolymer, a polyolefin copolymer, polyvinyl chlomide, and a ployamide.

6. The method of claim 1, wherein the flexible sheet material is secured to the door member and the jamb member with a pressure-sensitive adhesive.

7. The method of claim 1, further including the step of securing a third section of flexible sheet material to opposed longitudinal edges of the door member and door jamb outside of the first section of sheet material to protect an opposite side of said space between the hinged edge of the door member and the door jamb member.

8. The method of claim 7, wherein the third section of flexible sheet material is wider than said first and second sections of flexible sheet material.

* * * * *